US008401428B2

(12) United States Patent
Aratachi et al.

(10) Patent No.: US 8,401,428 B2
(45) Date of Patent: Mar. 19, 2013

(54) FIXING DEVICE HAVING A THERMISTOR AND A SUPPORT MEMBER FOR SUPPORTING THE THERMISTOR

(75) Inventors: Tomitake Aratachi, Toyokawa (JP); Masaki Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 722 days.

(21) Appl. No.: 12/506,491

(22) Filed: Jul. 21, 2009

(65) Prior Publication Data

US 2010/0028036 A1 Feb. 4, 2010

(30) Foreign Application Priority Data

Jul. 31, 2008 (JP) ..... 2008-198427

(51) Int. Cl.
*G03G 15/20* (2006.01)

(52) U.S. Cl. ..... 399/122; 399/330

(58) Field of Classification Search ..... 399/33, 399/122, 320, 328, 330; 219/216
See application file for complete search history.

(56) References Cited

U.S. PATENT DOCUMENTS

| | | | | |
|---|---|---|---|---|
| 5,937,230 | A * | 8/1999 | Iwase et al. | 399/69 |
| 5,966,566 | A | 10/1999 | Odagawa et al. | |
| 6,549,740 | B2 * | 4/2003 | Yoneda et al. | 399/122 |
| 7,027,075 | B2 | 4/2006 | Yokoi | |
| 7,203,439 | B2 | 4/2007 | Sone et al. | |
| 7,349,641 | B2 * | 3/2008 | Ogashima | 399/69 |
| 8,041,260 | B2 * | 10/2011 | Yoshida | 399/122 |
| 2007/0053712 | A1 * | 3/2007 | Fujiwara et al. | 399/88 |

FOREIGN PATENT DOCUMENTS

| | | |
|---|---|---|
| JP | 58-195256 | 12/1983 |
| JP | 62-142071 | 9/1987 |
| JP | 06-058815 | 3/1994 |
| JP | 06-130877 | 5/1994 |
| JP | 08-044229 | 2/1996 |
| JP | 08-095406 | 4/1996 |
| JP | 10-301421 | 11/1998 |
| JP | 2003-257591 | 9/2003 |
| JP | 2004-013024 | 1/2004 |
| JP | 2004-151232 | 5/2004 |

(Continued)

OTHER PUBLICATIONS

Office Action received in Japanese Patent Application 2008-198427 mailed Jul. 20, 2010.

*Primary Examiner* — Robert Beatty
(74) *Attorney, Agent, or Firm* — Banner & Witcoff, Ltd.

(57) ABSTRACT

A fixing device is mounted on a main casing of an image forming apparatus. A heating member contacts a recording medium to apply heat thereto while rotating. A heating member includes a roller that rotates about an axis. A frame supports the heating member and includes a frame fixing part that is fixed to the main casing to mount the frame on the main casing. A detecting unit opposes the heating member in an opposing direction to detect a temperature of the heating member and is separated from the heating member. A support member supports the detecting unit. A position of the support member in the opposing direction with respect to the frame is determined at a position closer to the frame fixing unit than the detecting unit. A position of the support member in an axial direction of the roller with respect to the frame is determined at a same position as the detecting unit in the axial direction.

9 Claims, 6 Drawing Sheets

FOREIGN PATENT DOCUMENTS

| | | | |
|---|---|---|---|
| JP | 2006-091342 | | 4/2006 |
| JP | 2006-184364 | | 7/2006 |
| JP | 2006195324 A | * | 7/2006 |
| JP | 2006-259718 | | 9/2006 |
| JP | 2007094326 A | * | 4/2007 |
| JP | 2007-213000 | | 8/2007 |

* cited by examiner

FIXING DEVICE HAVING A THERMISTOR AND A SUPPORT MEMBER FOR SUPPORTING THE THERMISTOR

CROSS REFERENCE TO RELATED APPLICATION

This application claims priority from Japanese Patent Application No. 2008-198427 filed Jul. 31, 2008. The entire content of the priority application is incorporated herein by reference.

TECHNICAL FIELD

The present invention relates to a fixing device, and more specifically a fixing device provided in an image-forming device.

BACKGROUND

Conventional electrophotographic printers have been provided with a fixing device for fixing toner images to paper. The fixing device includes a heating roller arranged with its axis extending in the width direction of the conveyed sheets of paper, and a temperature sensor such as a thermistor for detecting the surface temperature of the heating roller in order that the printer can control the fixing temperature.

A conventional fixing device has a non-contact thermistor disposed on a frame of the fixing device via a heat-insulating member. The non-contact thermistor measures the temperature of the heating roller in a region through which the paper passes in order to accurately control the temperature of the heating roller.

SUMMARY

According to the structure of the conventional fixing device, the non-contact thermistor provided on the frame of the fixing device is positioned relative to the heating roller. Since the thermistor must be disposed on the frame of the fixing device so as to oppose the surface of the heating roller, there are often restrictions on the assembly and layout of the thermistor relative to the frame of the fixing device.

Further, if the heat-insulating member expands due to heat emitted from the heating roller, the gap between the non-contact thermistor and the surface of the heating roller cannot be maintained at a fixed distance. Consequently, the thermistor cannot consistently detect the surface temperature of the heating roller with accuracy.

In view of the foregoing, it is an object of the present invention to provide a fixing device capable of consistently detecting the surface temperature of a heating member with accuracy, and particularly to such a fixing device having a detecting member precisely positioned relative to the heating member for detecting the surface temperature of the heating member.

This and other objects of the present invention will be attained by providing a fixing device mounted on a main casing of an image forming apparatus including a heating member, a frame, a detecting unit, and a support member. The heating member contacts a recording medium to apply heat thereto while rotating. The heating member includes a roller that rotates about an axis. The frame supports the heating member and includes a frame fixing part that is fixed to the main casing to mount the frame on the main casing. The detecting unit opposes the heating member in an opposing direction to detect a temperature of the heating member and is separated from the heating member. The support member supports the detecting unit. A position of the support member in the opposing direction with respect to the frame is determined at a position closer to the frame fixing unit than the detecting unit. A position of the support member in an axial direction of the roller with respect to the frame is determined at a same position as the detecting unit in the axial direction.

DETAILED DESCRIPTION

1. Overall structure of a printer

Figure 1:
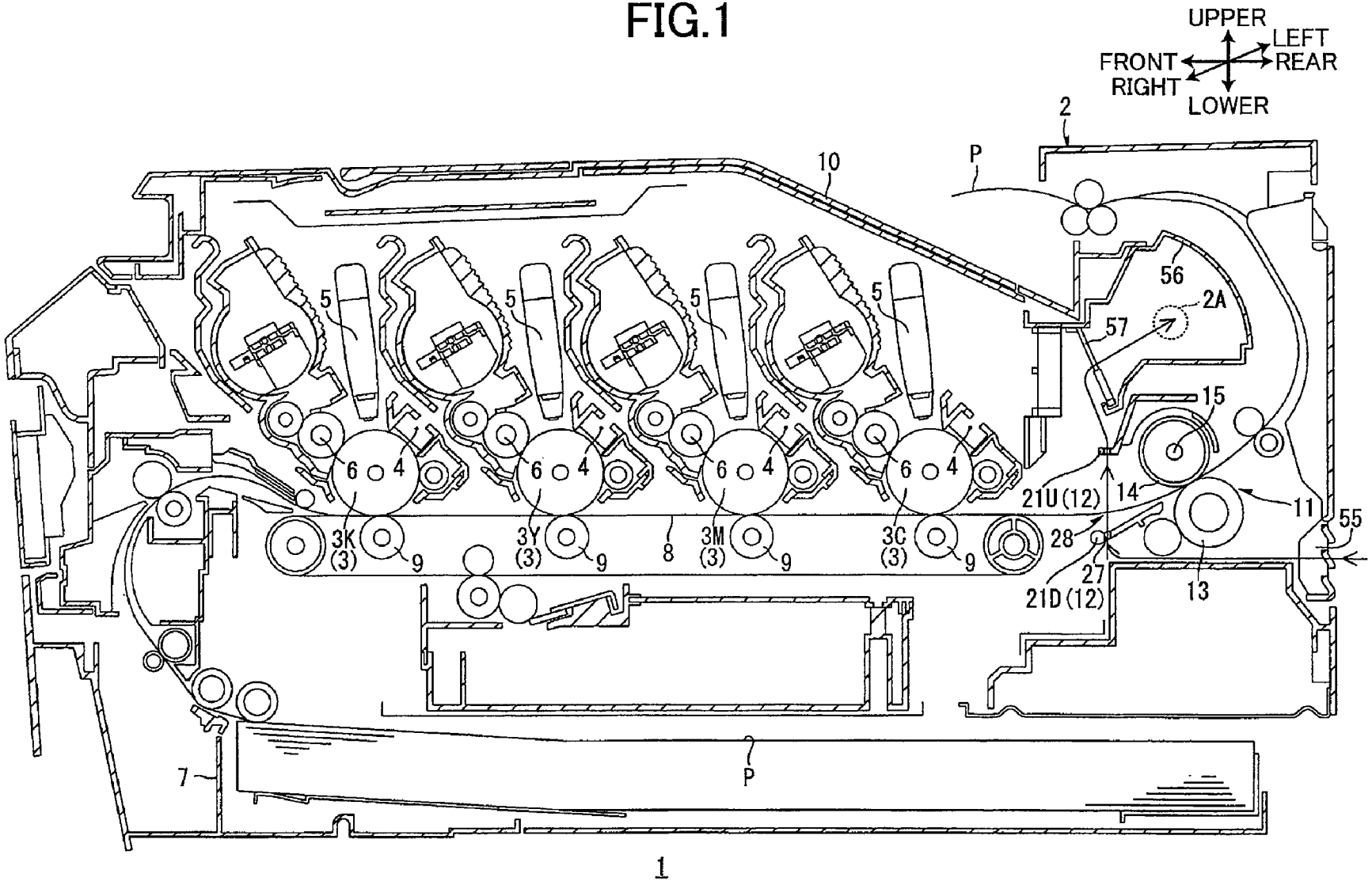
FIG. 1 is a side cross-sectional view of a printer including a fixing unit according to an embodiment of the present invention.

A fixing unit according to an embodiment of the present invention will be described with reference to accompany drawings. FIG. 1 is a side cross-sectional view of a printer 1 including a fixing unit 11 according to the embodiment. Directions relative to the printer 1 and the fixing unit 11 in the following description will be based on the assumption that printer 1 and fixing unit 11 are disposed in a level orientation. Direction arrows are provided in each drawing to indicate the orientation of the printer 1 and the fixing unit 11.

The printer 1 is a color printer. As shown in FIG. 1, the printer 1 has a main casing 2 serving as the main body of the printer 1. Within the main casing 2 are provided four photosensitive drums 3 juxtaposed in the front-to-rear direction and parallel to one another. In this embodiment, the four photosensitive drums 3 are differentiated as a black photosensitive drum 3K, a yellow photosensitive drum 3Y, a magenta photosensitive drum 3M, and a cyan photosensitive drum 3C serving to carry toner images in their respective colors black, yellow, magenta, and cyan.

A Scorotron charger 4, an LED 5, and a developing roller 6 are disposed in confrontation with each photosensitive drum 3. The charger 4' applies a uniform charge to the surface of the respective photosensitive drum 3, after which the LED 5 irradiates light onto the charged surface to form an electrostatic latent image based on image data. The electrostatic latent image is developed into a visible image by toner carried on the developing roller 6, resulting in a toner image (developer image) formed on the surface of the photosensitive drum 3.

The main casing 2 also includes a paper cassette 7 for accommodating sheets of a paper P. Various rollers are provided to convey sheets of the paper P from the paper cassette 7 to a conveying belt 8.

The conveying belt 8 is an endless belt extending in the front-to-rear direction, with the upper surface contacting each of the photosensitive drums 3. Transfer rollers 9 are disposed on the inside of the conveying belt 8 at positions opposing the photosensitive drums 3. As a sheet of paper P is conveyed on the conveying belt 8, toner images carried on the surfaces of the photosensitive drums 3 are transferred onto the sheet by a transfer bias applied to the transfer rollers 9 so as to be sequentially superimposed on the sheet of paper P.

After toner images in the four colors are transferred onto the sheet of paper P, the sheet is conveyed to the fixing unit 11, serving as an example of the fixing device according to the present invention. The fixing unit 11 fixes the toner images to the sheet of paper P with heat. Subsequently, various rollers convey and discharge the sheet of paper P out of the main casing 2 onto a discharge tray 10 formed on the top surface of the main casing 2.

2. Description of the fixing unit (2-1) Structure of the Fixing Unit

Figure 3:
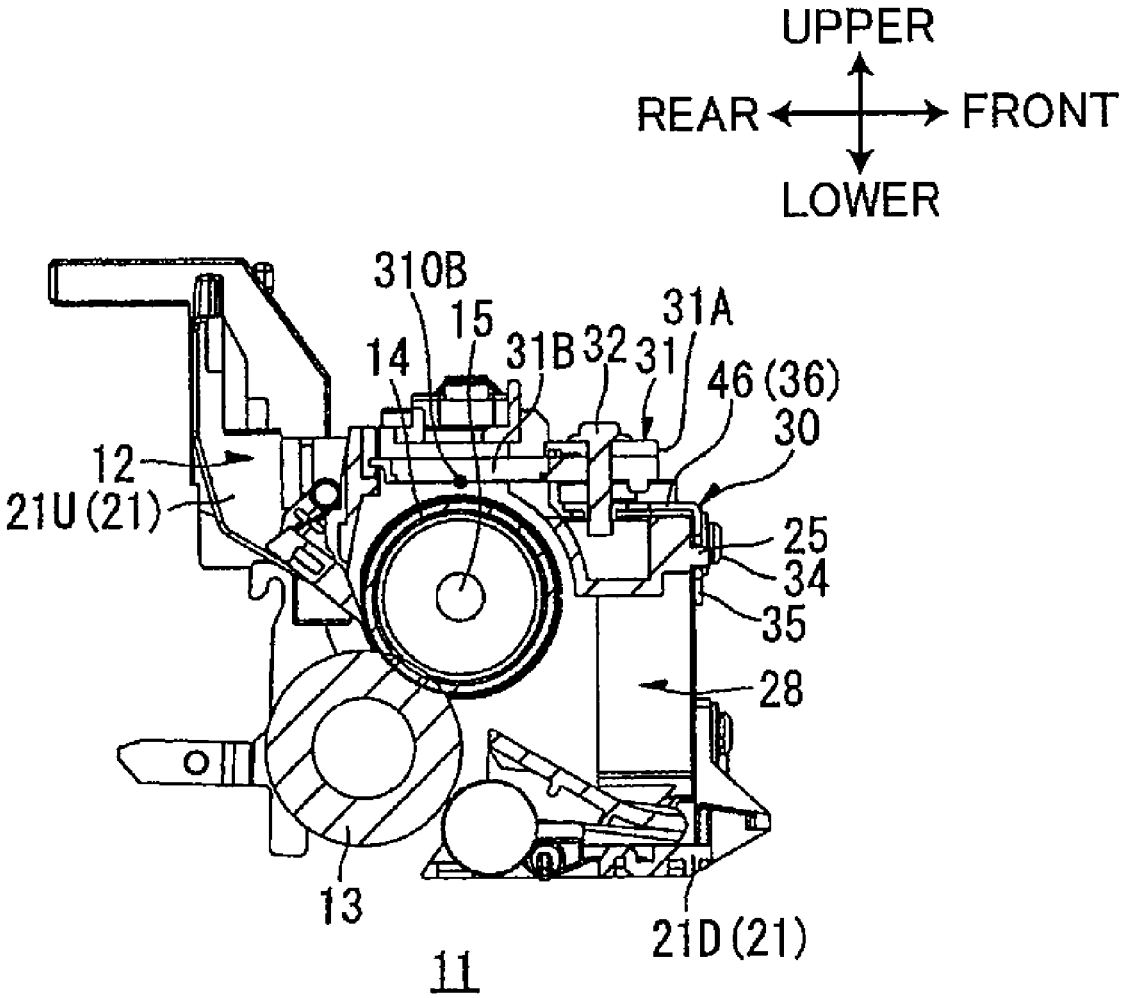
FIG. 3 is a cross-sectional view of the fixing unit taken along a line III-III shown in FIG. 2.

As shown in FIG. 3, the fixing unit 11 provided inside the main casing 2 includes a frame 12, a pressure roller 13, and a heating roller 14.

The heating roller 14 has a cylindrical shape with a longitudinal dimension extending in the left-to-right direction. That is, the axis of the heating roller 14 is aligned with the left-to-right direction. The heating roller 14 is formed of aluminum or another metal and is surface-coated with fluororesin. A heater 15, such as a halogen lamp, elongated in the left-to-right direction is inserted inside the heating roller 14 so as to be radially separated from the inner surface of the heating roller 14.

Figure 2:
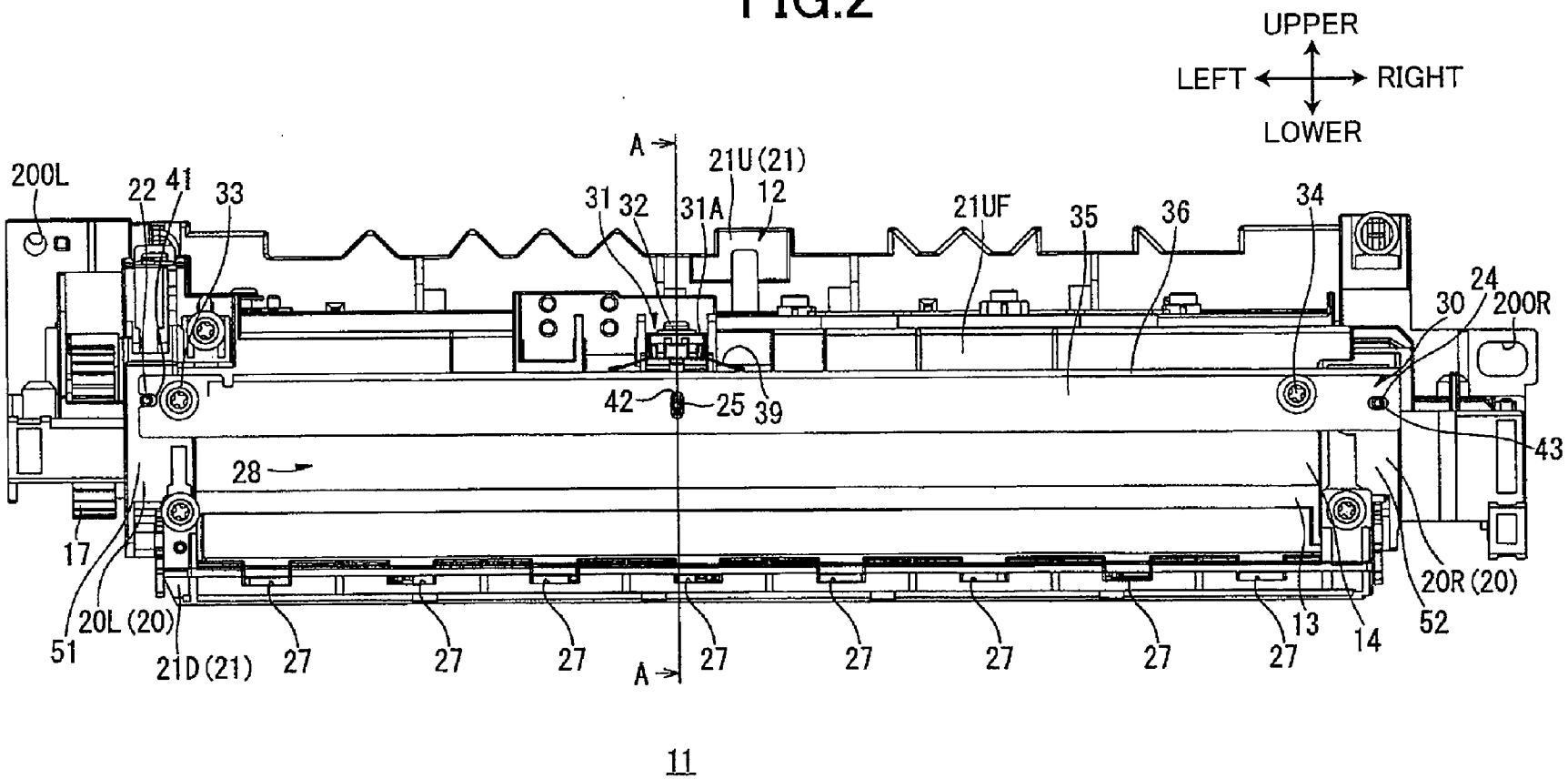
FIG. 2 is a front view of the fixing unit shown in FIG. 1.
Figure 4:
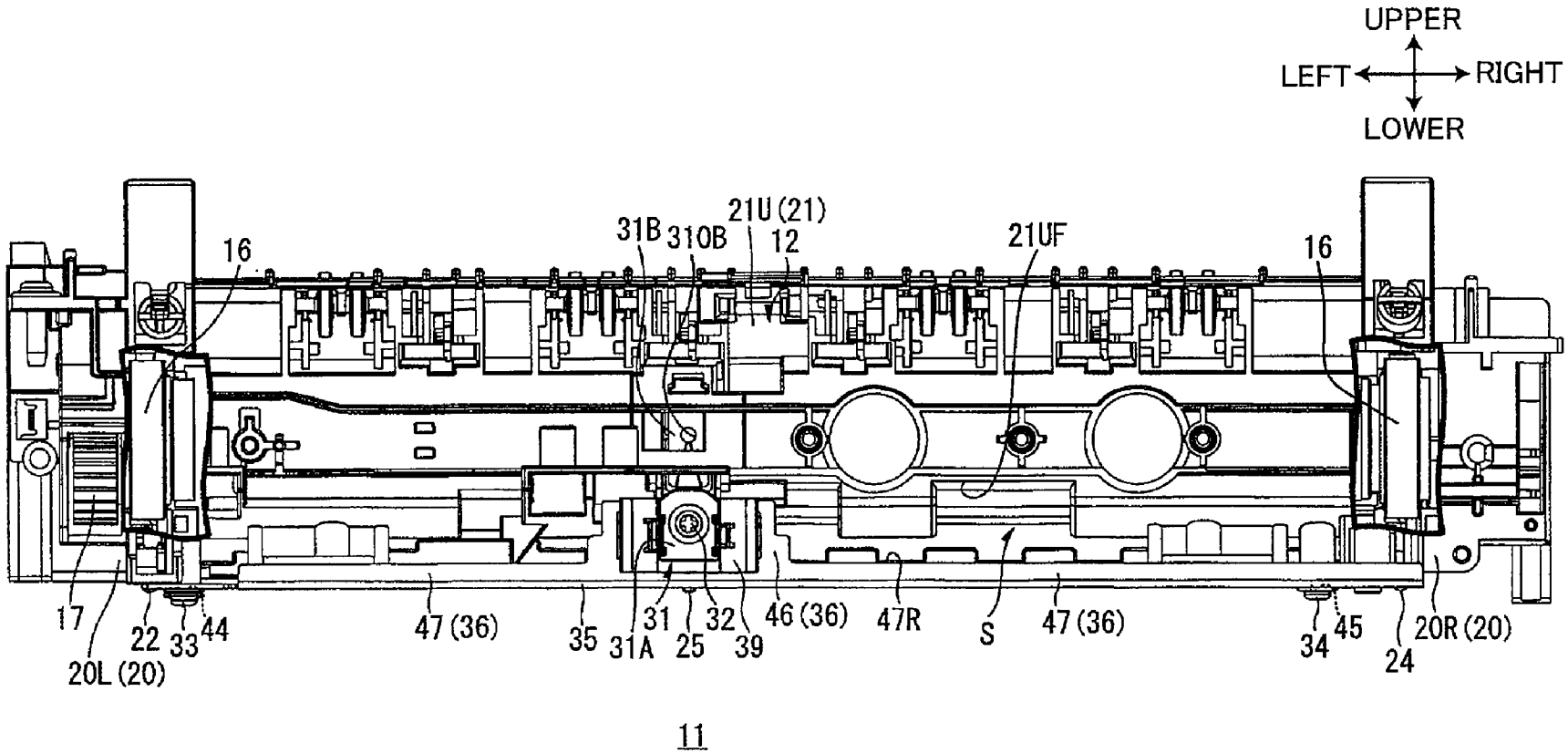
FIG. 4 is a plan view of the fixing unit shown in FIG. 2 with partial cutout regions.

Ring-shaped bearing members 16 are fitted around the left and right ends of the heating roller 14 (see the cutout portions in FIG. 4). The bearing members 16 rotatably support the ends of the heating roller 14. A gear 17 is provided on the left end of the heating roller 14, as shown in FIG. 2. The gear 17 inputs a drive force for rotating the heating roller 14. As shown in FIG. 3, the pressure roller 13 is disposed below and slightly rearward of the heating roller 14 and is rotatably supported in the frame 12. The pressure roller 13 contacts the heating roller 14 with pressure from below.

When a sheet of paper P enters the fixing unit 11 and is conveyed between the heating roller 14, which is driven to rotate, and the pressure roller 13, which follows the rotation of the heating roller 14, the heating roller 14 contacts and applies heat to the sheet while the pressure roller 13 presses the sheet against the heating roller 14, thereby fixing toner to the sheet with heat. The sheet is subsequently conveyed out of the fixing unit 11 by the rotating heating roller 14 and pressure roller 13.

The frame 12 is formed of a hard plastic material. As shown in FIGS. 2 and 4, the frame 12 is substantially rectangular in shape in a plan view and elongated in the left-to-right direction. The frame 12 accommodates and supports the heating roller 14.

The frame 12 is integrally configured of fixing parts 20, disposed one each on the left and right ends of the frame 12 (hereinafter, the left and right fixing parts 20 will be referred to as a left fixing part 20L and a right fixing part 20R); and a cover part 21 spanning between the fixing parts 20.

A screw hole 200L is formed in the left fixing part 20L. The left fixing part 20L is fixed to a left wall of the main casing 2 by inserting a screw (not shown) through the screw hole 200L and fastening the screw to the left wall of the main casing 2.

Similarly, a screw hole 200R is formed in the right fixing part 20R. The right fixing part 20R is fixed to a right wall of the main casing 2 by inserting a screw (not shown) through the screw hole 200R and fastening the screw to the right wall of the main casing 2.

Consequently, the main casing 2 restricts thermal expansion (linear expansion) of the frame 12 in the left and right directions when the frame 12 absorbs heat from the heating roller 14.

As shown in the cutout portions of FIG. 4, the left and right fixing parts 20L and 20R support the respective bearing members 16.

The cover part 21 extends in the left-to-right direction across (throughout) the entire heating roller 14 between the fixing parts 20 and serves to cover the heating roller 14. As shown in FIG. 3, the cover part 21 includes an upper cover part 21U disposed above the heating roller 14, and a lower cover part 21D disposed below the heating roller 14.

The upper cover part 21U is disposed over the heating roller 14 across the left-to-right dimension thereof so as to cover the top of the heating roller 14. As will be described later in greater detail, as shown in FIG. 4, the upper cover part 21U has a front edge 21UF that opposes a rear edge 47R of a separated part 47 on a support member 30, but is separated from the rear edge 47R in the front-to-rear direction by a gap S.

Figure 5:
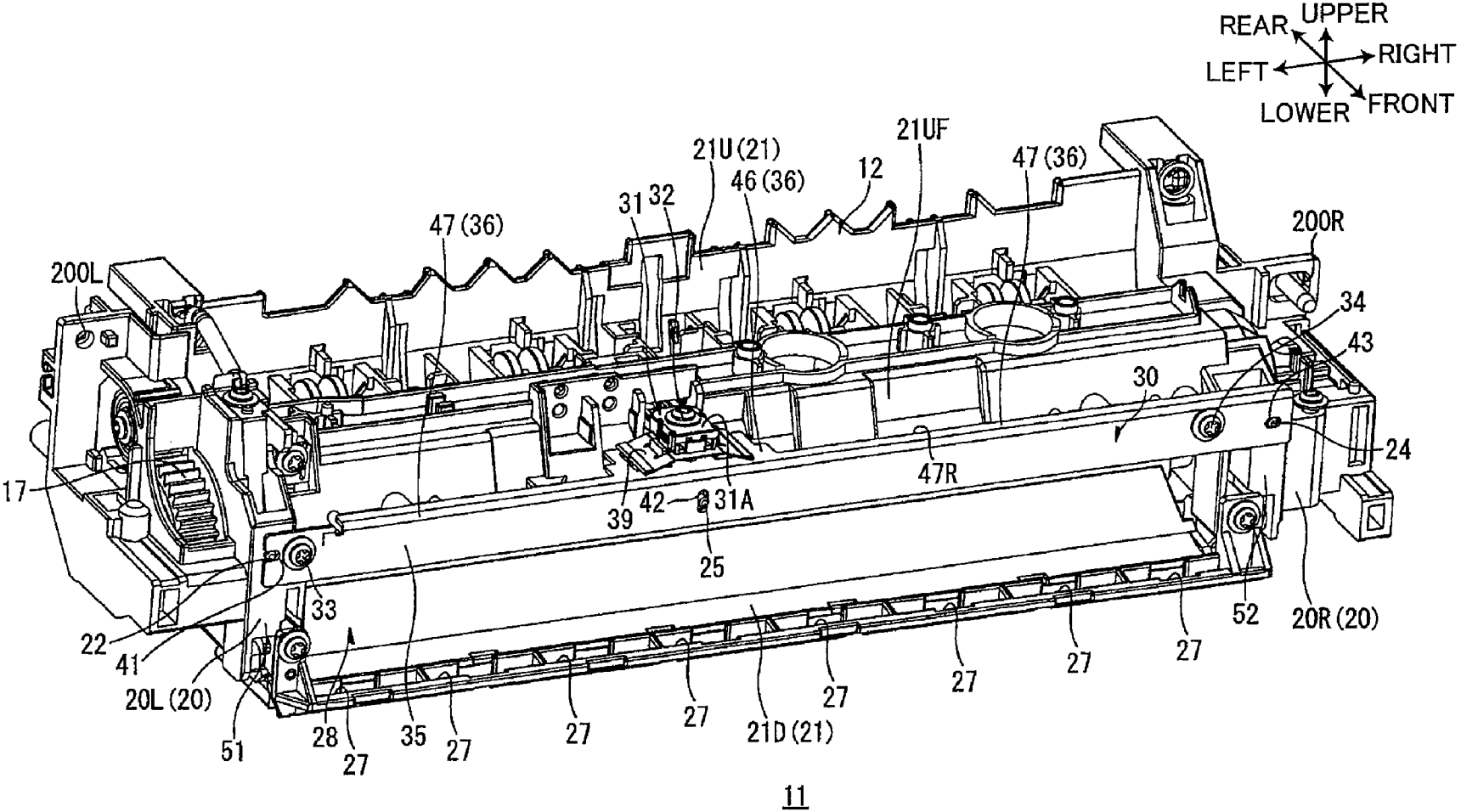
FIG. 5 is a perspective view of the fixing unit according to the embodiment.

As shown in FIG. 3, the lower cover part 21D has a flat plate shape and is disposed on the front side of the heating roller 14. The lower cover part 21D slopes upward from the front end to the rear end for guiding sheets of the paper P in between the heating roller 14 and pressure roller 13. As shown in FIG. 5, a plurality of through-holes 27 is formed in the front end of the lower cover part 21D. The through-holes 27 are rectangular in a plan view and are arranged at intervals in the left-to-right direction.

The upper and lower cover parts 21U and 21D are disposed such that their front ends oppose each other vertically. A paper-conveying space 28 is formed between the upper and lower cover parts 21U and 21D to allow paper P to pass through to the heating roller 14.

The gap S is formed between the front edge 21UF of the upper cover part 21U and the rear edge 47R of the separated part 47, which is part of a support member 30 described later. The gap S together with the through-holes 27 allow heated air within the frame 12 to escape.

By allowing air to escape easily from the frame 12, the above construction produces a stable airflow around a thermistor 31 described later, thus improving the precision with which the thermistor 31 detects temperature.

More specifically, as shown in FIG. 1, the main casing 2 is provided with an air intake 55 formed in the rear wall of the main casing 2 for drawing external air into the main casing 2, a filter 57 disposed above the front edge 21UF of the upper cover part 21U, and a duct 56 disposed to the rear of the filter 57.

As indicated by arrows in FIG. 1, air introduced into the main casing 2 through the air intake 55 flows into the frame 12 via the through-holes 27 and flows out of the frame 12 through the gap S formed between the front edge 21UF of the upper cover part 21 U and the rear edge 47R of the separated part 47. Accordingly, the airflow produced in this structure expels heat from the frame 12.

Air expelled from the frame 12 passes through the filter 57 and flows into the duct 56, which is elongated in the left-to-right direction. Subsequently, the air is discharged from an outlet 2A formed in the right wall of the main casing 2.

Figure 6:
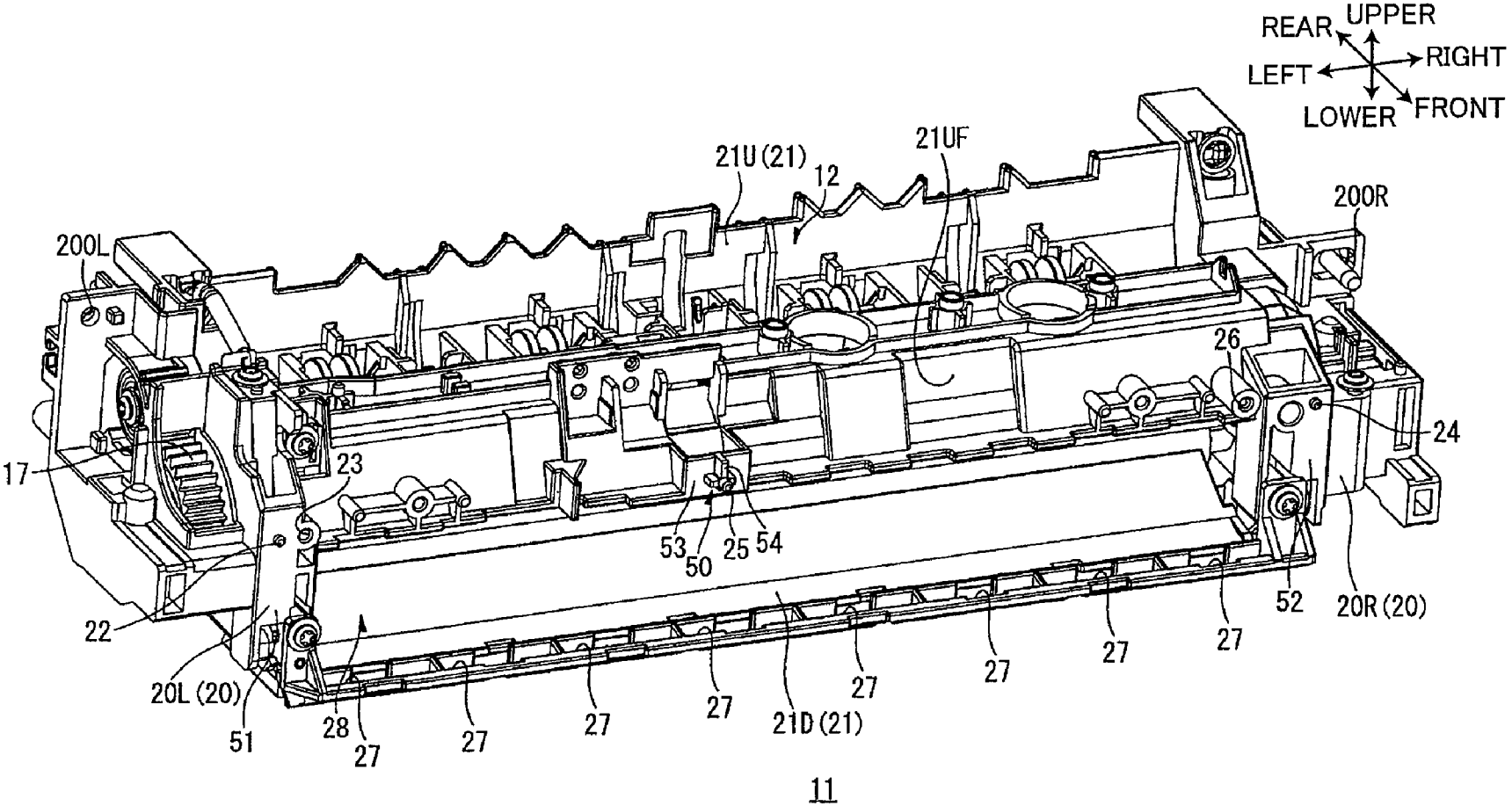
FIG. 6 is a perspective view of the fixing unit without a support member and a thermistor shown in FIG. 5.

(2-2) Description of the Support Member Supporting the Thermistor (2-2-1) Structure of the Frame As shown in FIG. 6, the left fixing part 20L of the frame 12 is flat with a front surface 51 occupying a vertical plane, and has a substantially rectangular shape in a front view. A left rib 22 is formed on the front surface 51 and a left screw hole 23 is formed in the front surface 51.

The left rib 22 is substantially circular in a front view and protrudes forward from the upper end of the front surface 51.

The left rib 22 is inserted into a left cutout part 41 of the support member 30 described later (see FIG. 2).

The left screw hole 23 is located on the left fixing part 20L side of the thermistor 31 with respect to the axial direction of the heating roller 14. More specifically, the left screw hole 23 is formed adjacent to but separated from the right side of the left rib 22 and is in a protuberant part of the left fixing part 20L that protrudes rightward from the right edge of the left fixing part 20L. A left screw 33 is threaded into the left screw hole 23 (see FIG. 2).

The right fixing part 20R of the frame 12 is flat with a front surface 52 occupying a vertical plane, and has a substantially rectangular shape in a front view. A right rib 24 is formed on the front surface 52.

The right rib 24 is substantially circular in shape in a front view and protrudes forward from the upper end of the front surface 52. The right rib 24 is inserted into a right elongated hole 43 of the support member 30 described later (see FIG. 2).

The upper cover part 21U of the frame 12 includes a thermistor mounting part 50, and a right screw hole 26.

The thermistor mounting part 50 is disposed in the left-to-right center of the upper cover part 21U and is integrally provided with a seat 53, a spacer 54, and a center rib 25.

The seat 53 has a box shape and protrudes forward from the front surface (the front edge 21UF) of the upper cover part 21U. The seat 53 is open on the top and forms three sides of a rectangle in a plan view.

The spacer 54 is shaped like a cross in a front view and protrudes forward from the front surface of the seat 53.

The center rib 25 is substantially circular in a front view and protrudes forward from the intersecting portion of the cross-shaped spacer 54 in substantially the left-to-right center of the upper cover part 21U. The center rib 25 is disposed so as to overlap the left-to-right center of the paper-conveying space 28 when projected in the front-to-rear direction.

The right screw hole 26 is disposed on the right fixing part 20R side of the thermistor 31 with respect to the axial direction of the heating roller 14. More specifically, the right screw hole 26 is cylindrical in shape and protrudes forward from the front surface (the front edge 21UF) of the upper cover part 21U on the right end of the upper cover part 21U. The right screw hole 26 is adjacent to but separated a distance from the left side of the right rib 24. A right screw 34 is threaded into the right screw hole 26 (see FIG. 2).

In a plan view, the front surface of the spacer 54 is flush with the front surfaces 51 and 52 of the left and right fixing parts 20L and 20R, respectively.

(2-2-2) Structures of the Support Member and Thermistor

As shown in FIG. 5, the fixing unit 11 includes the support member 30, and the thermistor 31.

The support member 30 is formed of a stainless steel plate or the like in a flat plate shape and spans between the fixing parts 20. The support member 30 includes a positioning plate 35 for determining the position of the support member 30 on the frame 12, and an inflected plate 36 formed continuously with the positioning plate 35. The inflected plate 36 extends from the upper edge of the positioning plate 35 toward the upper cover part 21U of the frame 12.

The positioning plate 35 has a long, narrow rectangular shape in a plan view and is elongated in the left-to-right direction. The length of the positioning plate 35 in the left-to-right direction is slightly greater than the length of the cover part 21 in the same direction and is set so that both ends of the positioning plate 35 overlap the fixing parts 20 when the positioning plate 35 is projected in the front-to-rear direction.

The left cutout part 41, a center elongated hole 42, and the right elongated hole 43 are formed in the positioning plate 35.

The left cutout part 41 is formed in the left edge of the positioning plate 35 by cutting rightward into the edge of the positioning plate 35 to form a U-shaped notch that is open on the left. The vertical dimension of the left cutout part 41 is slightly larger than the diameter of the left rib 22 to allow the left rib 22 to be inserted into the left cutout part 41. The left-to-right dimension of the left cutout part 41 is approximately 1.5 times the vertical dimension.

The center elongated hole 42 is elongated vertically and formed in the left-to-right center region of the positioning plate 35 so as to oppose the center rib 25. The left-to-right dimension of the center elongated hole 42 is slightly larger than the diameter of the center rib 25 to allow the center rib 25 to be inserted into the center elongated hole 42. The vertical dimension of the center elongated hole 42 is approximately 3 times the left-to-right dimension.

The right elongated hole 43 is elongated in the left-to-right direction and formed in the right end of the positioning plate 35 so as to oppose the right rib 24. The vertical dimension of the right elongated hole 43 is slightly larger than the diameter of the right rib 24 to allow insertion of the right rib 24, while the left-to-right dimension is approximately 2 times the vertical dimension.

As shown in FIG. 4, a left screw through-hole 44 and a right screw through-hole 45 are formed in the positioning plate 35.

The left screw through-hole 44 is disposed adjacent to the right side of the left cutout part 41 so as to oppose the left screw hole 23 formed in the frame 12. The right screw through-hole 45 is disposed near the left side of the right elongated hole 43 so as to oppose the right screw hole 26 formed in the frame 12. The right screw through-hole 45 is separated from the right elongated hole 43 by a distance slightly greater than the distance between the left cutout part 41 and the left screw through-hole 44.

As shown in FIG. 5, the inflected plate 36 is formed on the top of the positioning plate 35, spanning from the right end of the positioning plate 35 to a position near the left end of the same. The inflected plate 36 is inflected from the top edge of the positioning plate 35 and protrudes rearward. The inflected plate 36 includes a support part 46 for supporting the thermistor 31, and the separated part 47 that opposes but is separated a prescribed distance from the frame 12.

As shown in FIGS. 4 and 5, the support part 46 has a substantially rectangular shape in a plan view and protrudes farther rearward than the separated part 47. The support part 46 is positioned in substantially the left-to-right center of the support member 30 so as to oppose the seat 53 of the frame 12. The support part 46 is disposed so that the left-to-right center of the support part 46 is aligned with the center rib 25 in the left-to-right direction. The support part 46 has a length in the front-to-rear direction capable of supporting the thermistor 31. Specifically, the front-to-rear length of the support part 46 is equivalent to the length between the positioning plate 35 and the front surface (i.e. the front edge 21UF) of the frame 12 opposing the positioning plate 35.

The separated part 47 extends in the left-to-right direction and protrudes rearward less than the support part 46. Excluding the portion of the inflected plate 36 on which the support part 46 is formed, the separated part 47 is provided across the entire length of the inflected plate 36.

The thermistor 31 is a non-contact temperature sensor that includes a base part 31A, a leaf spring 39, a mounting part 31B (see FIG. 3), and a sensor part 310B (see FIG. 3). The leaf spring 39 urges the base part 3 1A upward. The mounting part 31B protrudes rearward from the base part 31A. A portion of the mounting part 31B is composed of a transparent film. The sensor part 3 10B is attached to the transparent film from below.

The base part 31A has a flat plate shape that is substantially rectangular in a plan view.

The leaf spring 39 is configured of a steel plate that is substantially rectangular in a plan view, and is bent to form a trapezoidal shape in a front view that is open on the bottom. The base part 31A rests on the top surface of the leaf spring 39. Screw holes (not shown) are also formed in the left-to-right center of the base part 3 1A and leaf spring 39.

A thermistor-fixing screw 32 is inserted through the screw holes in the base part 3 1A and leaf spring 39 and screwed into a screw hole (not shown) formed in the left-to-right center of the support part 46 to fix the base part 31A and leaf spring 39 to the support member 30.

As shown in FIG. 3, the mounting part 31B extends in the front-to-rear direction rearward from the rear edge of the base part 31A. The sensor part 310B is provided at a mid-point of the mounting part 31B along the front-to-rear direction thereof for detecting the temperature of the heating roller 14.

The sensor part 310B is disposed at a position nearest the surface of the heating roller 14. Specifically, the sensor part 310B is disposed at the intersection of a line extending radially from the heating roller 14 and a line extending along the elongated direction of the mounting part 31B (front-to-rear direction). Accordingly, the sensor part 310B confronts the surface of the heating roller 14 vertically while being separated therefrom, as shown in FIG. 3, and functions to detect the surface temperature of the heating roller 14.

(2-2-3) Supporting the Thermistor with the Support Member

To mount the thermistor 31 on the fixing unit 11, first the base part 31A of the thermistor 31 and the leaf spring 39 are fixed to the support part 46 of the support member 30 with the thermistor-fixing screw 32, as described above.

By pressing the base part 31A of the thermistor 31 downward with the thermistor-fixing screw 32 against the upward urging force of the leaf spring 39, the base part 31A becomes positioned vertically and in the left-to-right direction relative to the support member 30.

Next, as illustrated in FIGS. 5 and 6, the left cutout part 41 of the support member 30 is aligned with the left rib 22 of the frame 12, the center elongated hole 42 of the support member 30 with the center rib 25 of the frame 12, and the right elongated hole 43 of the support member 30 with the right rib 24 of the frame 12. Further, the left rib 22 is inserted into the left cutout part 41, the center rib 25 into the center elongated hole 42, and the right rib 24 into the right elongated hole 43. At the same time, the support part 46 is arranged above the seat 53 of the frame 12, with the positioning plate 35 contacting the front surfaces 51 and 52 of the fixing part 20 and the front surface of the spacer 54.

Since the left-to-right center of the support part 46 is aligned with the center elongated hole 42 in the left-to-right direction, a position of the support member 30 in the left-to-right direction on the frame 12 is determined at the same position as the thermistor 31.

After performing this position determining, the mounting part 31B extends in the front-to-rear direction from the rear end of the base part 31A. Accordingly, the sensor part 310B is aligned with the base part 31A in the left-to-right direction. That is, the sensor part 310B is fixed in position at the left-to-right center of the support part 46 in a front view.

In this way, positions of the surface of the heating roller 14 and the sensor part 310B of the thermistor 31 in the left-to-right direction are determined. The support member 30 is positioned vertically by inserting the left rib 22 through the left cutout part 41 and the right rib 24 through the right elongated hole 43. Consequently, the sensor part 310B of the thermistor 31 is positioned vertically relative to the surface of the heating roller 14.

Next, the right screw 34 is inserted through the right screw through-hole 45 of the support member 30 and screwed into the right screw hole 26 of the frame 12. Similarly, the left screw 33 is inserted through the left screw through-hole 44 and screwed into the left screw hole 23. Accordingly, the support member 30 is fixed in the front-to-rear direction relative to the frame 12.

In this way, the support member 30 is fixed by the right screw hole 26 provided near the right fixing part 20R and the left screw hole 23 provided near the left fixing part 20L, with the positioning plate 35 contacting the front surfaces 51 and 52 of the fixing part 20 and the front surface of the spacer 54. Accordingly, a position of the support member 30 is determined in the left-to-right direction and the direction in which the heating roller 14 and thermistor 31 oppose each other.

3. Operations and Effects of the Invention (1) In the fixing unit 11 described above, the thermistor 31 is supported on the support member 30, and the support member 30 is positioned on the frame 12. In other words, the support member 30 is prepared as a separate member from the frame 12 for positioning the thermistor 31 relative to the heating roller 14. This provides more freedom in the method of assembling the thermistor 31 on the support member 30 and the layout of this assembly and enables the thermistor 31 to be mounted on the support member 30 at a position relative to the heating roller 14 from which the thermistor 31 can more accurately detect the temperature of the heating roller 14 (central position in the left-to-right direction).

Hence, the thermistor 31 can be mounted and positioned relative to the heating roller 14 with greater accuracy.

Further, since the left and right fixing parts 20L and 20R are fixed to the respective left and right walls of the main casing 2, the main casing 2 of the printer I restricts expansion of the frame 12 in the left-to-right direction caused by heat emitted from the heating roller 14.

In the fixing unit 11 described above, the left and right fixing parts 20L and 20R restrict thermal expansion of the frame 12 in the left-to-right direction. Consequently, the cover part 21 of the frame 12 may bow in the vertical and front-to-rear directions, with the left and right fixing parts 20L and 20R serving as base points.

However, in the fixing unit 11 of this embodiment, the left rib 22 formed on the frame 12 is inserted into the left cutout part 41 of the support member 30 while the right rib 24 of the frame 12 is inserted into the right elongated hole 43 of the support member 30, thereby determining the vertical position of the support member 30 relative to the frame 12 at the left and right fixing parts 20L and 20R (i.e. at positions closer to the left and right fixing parts 20L and 20R than the thermistor 31).

Further, by inserting the right screw 34 through the right screw through-hole 45 of the support member 30 and screwing the right screw 34 into the right screw hole 26 of the frame 12 and by inserting the left screw 33 through the left screw through-hole 44 of the support member 30 and screwing the left screw 33 into the left screw hole 23, the front-to-rear position of the support member 30 is determined relative to the frame 12. Hence, a position of the support member 30 in the front-to-rear direction relative to the frame 12 is determined at positions closer to the left and right fixing parts 20L and 20R than the thermistor 31.

By restricting movement of the support member 30 in the vertical and left-to-right directions, it is possible to reliably suppress fluctuations in the gap between the sensor part 310B of the thermistor 31 supported on the support member 30 and the opposing surface of the heating roller 14. Consequently, the thermistor 31 can detect the surface temperature of the heating roller 14 with accuracy.

Moreover, by inserting the center rib 25 into the center elongated hole 42 at a position equivalent to the thermistor 31 in the left-to-right direction, a position of the support member 30 on the frame 12 is determined. Hence, positions of the heating roller 14 and thermistor 31 in the left-to-right direction are determined.

Accordingly, the support member 30 can hold the thermistor 31 so as to maintain a uniform gap between the thermistor 31 and the surface of the heating roller 14 and to maintain the position of the thermistor 31 relative to the heating roller 14 in the left-to-right direction, thereby enabling the thermistor 31 to detect the temperature of the heating roller 14 with accuracy.

(2) In the fixing unit 11 of this embodiment described above, the support member 30 is provided with the positioning plate 35, and the inflected plate 36 formed continuously with the positioning plate 35 along a plane inflected therefrom. Thus, the inflected plate 36 improves the rigidity of the support member 30.

As a result, the thermistor 31 can be mounted and positioned with greater accuracy relative to the heating roller 14.

(3) Further, in the fixing unit 11 of this embodiment, the support part 46 of the inflected plate 36 can reliably support the thermistor 31 while allowing the movement of air between the interior and exterior of the frame 12 through the gap S formed between the separated part 47 of the inflected plate 36 and the frame 12. In other words, air inside the frame 12 can escape through the gap S formed between the rear edge 47R of the separated part 47 of the inflected plate 36 and the front edge 21UF of the upper cover part 21U, thereby expelling heat from the frame 12. Heated air expelled from the frame 12 passes through the filter 57 and is discharged from the duct 56, as described above.

By effectively expelling heat from the interior of the frame 12 in this way, the construction of the fixing unit 11 suppresses expansion of the frame 12, allowing the temperature of the heating roller 14 to be detected with greater accuracy.

(4) In the fixing unit 11 of this embodiment, through-holes 27 are formed in the lower cover part 21D, allowing the flow of air between the interior and exterior of the frame 12 via the through-holes 27. Specifically, air introduced into the printer through the air intake 55 can flow into the frame 12 through the through-holes 27, as described above. Air introduced into the frame 12 flows out of the frame 12 through the gap S between the rear edge 47R of the separated part 47 and the front edge 21UF of the upper cover part 21U, thereby expelling interior heat from the frame 12. Air expelled from the frame 12 passes through the filter 57 and is discharged from the duct 56.

As a result, heat inside the frame 12 can be more effectively discharged, suppressing expansion of the frame 12 and allowing the temperature of the heating roller 14 to be even more accurately detected.

(5) In the fixing unit 11 of this embodiment, bearing members 16 for rotatably supporting both ends of the heating roller 14 are themselves supported on the fixing parts 20. Accordingly, the fixing parts 20 support both the bearing members 16, which support the heating roller 14, and the support member 30, which supports the thermistor 31.

Consequently, the thermistor 31 can be mounted and positioned with greater accuracy relative to the heating roller 14.

(6) In the fixing unit 11 of this embodiment, the frame 12 is integrally provided with the cover part 21 covering the heating roller 14 along its axial direction, and the fixing parts 20. Hence, this construction reduces the number of parts in the fixing unit 11.

4. Variations of the Embodiment

The printer in this embodiment described above is a direct tandem type color printer having four photosensitive drums. However, the image-forming device of the present invention may be an intermediate transfer tandem type color printer, a monochromatic printer, or any other electrophotographic printer.

In this embodiment described above, the photosensitive drums 3 are exposed by LEDs 5, but the photosensitive drums 3 may be exposed by laser scanners, for example.

In this embodiment described above, a heating roller serves as the heating member, but a heating film used in a film fixing method or a heating belt may be used instead. In this case, the heating film or heating belt is arranged so that its direction of movement (circulating direction) is orthogonal to the axial direction of the heating roller in the above embodiment.

What is claimed is:

1. A fixing device configured to be mounted on a main casing of an image forming apparatus, comprising:

a heating member configured to contact a recording medium to apply heat thereto while rotating about an axis;

a frame that supports the heating member and includes a frame fixing part configured to be fixed to the main casing to mount the frame on the main casing;

a detecting unit that opposes the heating member in an opposing direction, wherein the detecting unit is configured to detect a temperature of the heating member and wherein the detecting unit is separated from the heating member; and a support member that supports the detecting unit, wherein a first support member fixing part of the support member is located at a position closer to the frame fixing part than the detecting unit, and wherein a second support member fixing part of the support member is located at a same position as the detecting unit in an axial direction with respect to the frame, wherein the first and second support member fixing parts are configured for attaching the support member to the frame.

2. The fixing device according to claim 1, wherein the support member comprises:

a positioning plate that determines the position of the support member with respect to the frame, the positioning plate having an edge in the opposing direction; and an inflected plate that is formed continuously with the positioning plate and extends from the edge of the positioning plate toward the frame, and wherein the detecting unit is supported by the inflected plate.

3. The fixing device according to claim 2, wherein the inflected plate comprises:

a support part that supports the detecting unit and protrudes toward the frame; and a separated part that protrudes toward the frame less than the support part and is separated from the frame.

4. The fixing device according to claim 3, wherein the frame is formed with a space to allow the recording medium to pass through to the heating member, and wherein the frame comprises a hole formed part that opposes the support member with the space interposing between a hole formed part and the support member, the hole formed part being formed with a through-hole.

5. The fixing device according to claim 1, further comprising a pair of bearing members that rotatably supports both ends of the heating member and is supported by the frame fixing part.

6. The fixing device according to claim 1, wherein the frame comprises a cover part that extends in the axial direction across the heating member and covers the heating member, the cover part being integrally provided with the frame fixing part.

7. The fixing device of claim 1, wherein the first support member fixing part has a first shape configured to allow movement of the support member in the axial direction and to prohibit movement in the opposing direction, and wherein the second support member fixing part has a second shape configured to allow movement of the support member in the opposing direction and to prohibit movement in the axial direction.

8. The fixing device of claim 7, wherein the first support member fixing part includes a first opening that is elongated in the axial direction and the second support member fixing part includes a second opening that is elongated in the opposing direction.

9. The fixing device of claim 1, wherein the support member includes a first side and a second side in the opposing direction, wherein the first side of the support member includes a bent portion, and wherein the detecting unit is attached to the bent portion.

* * * * *